US005714739A

United States Patent [19]

Irrera et al.

[11] Patent Number: 5,714,739

[45] Date of Patent: Feb. 3, 1998

[54] CONTROL DEVICE PARTICULARLY FOR INDUCTION COOKING RANGES WITH MULTIPLE HEATING ELEMENTS

[75] Inventors: Massimo Irrera, Padova; Tiziano Meneghetti, Rossano Veneto, both of Italy

[73] Assignee: Meneghetti Ampelio & C. S.n.c., Rosa' , Italy

[21] Appl. No.: 589,507

[22] Filed: Jan. 22, 1996

[30] Foreign Application Priority Data

Jan. 25, 1995 [IT] Italy ..... PD95A0022

[51] Int. Cl.[6] ..... H05B 6/08; H05B 6/12

[52] U.S. Cl. ..... 219/626; 219/665; 219/662

[58] Field of Search ..... 219/625, 626, 219/627, 663, 662, 665, 667

[56] References Cited

U.S. PATENT DOCUMENTS

| | | | |
|---|---|---|---|
| 4,092,509 | 5/1978 | Mitchell . | |
| 4,092,510 | 5/1978 | Kiuchi et al. . | |
| 4,112,287 | 9/1978 | Oates et al. . | |
| 4,275,281 | 6/1981 | Kiuchi | 219/626 |
| 4,320,273 | 3/1982 | Kiuchi . | |
| 4,426,564 | 1/1984 | Steigerwald et al. | 219/662 |
| 4,456,807 | 6/1984 | Ogino et al. | 219/626 |
| 4,511,781 | 4/1985 | Tucker et al. . | |
| 4,560,851 | 12/1985 | Tsukamoto et al. | 219/626 |
| 5,010,223 | 4/1991 | Kim | 219/662 |
| 5,523,631 | 6/1996 | Fishman et al. | 219/662 |

FOREIGN PATENT DOCUMENTS

| | | |
|---|---|---|
| 286044 | 10/1988 | European Pat. Off. . |
| 3612707 | 10/1986 | Germany . |
| 3610196 | 10/1987 | Germany . |

*Primary Examiner*—Philip H. Leung
*Attorney, Agent, or Firm*—Guido Modiano; Albert Josif

[57] ABSTRACT

A control device particularly for induction cooking ranges with multiple heating units which comprises a plurality of induction coils. The induction coils can be electrically parallel-connectable to each other. The device also comprises elements for engaging the induction coils connecting individual induction coils or pairs of induction coils to a single electric power converter, and elements for sensing the presence or the absence of a pot or the presence of an unadapted pot on a particular induction coil; the sensor elements are electrically connected to control means that select, on user's command, the induction coils to be activated and the power to be carried to each individual induction coil, and control the sending of shares of the power generated by the electronic converter to each active induction coil, at the same time limiting the periodic variations in the current absorbed from the mains, within the limits allowed by statutory provisions regarding so-called "flicker".

5 Claims, 3 Drawing Sheets

CONTROL DEVICE PARTICULARLY FOR INDUCTION COOKING RANGES WITH MULTIPLE HEATING ELEMENTS

BACKGROUND OF THE INVENTION

The present invention relates to a control device particularly for induction cooking ranges with multiple heating elements.

Conventional induction heating elements for cooking are essentially constituted by a so-called induction coil, which generates in the overlying pot, made of ferromagnetic material, induced currents, known as Foucault currents, which heat it by Joule effect, once said coil has been supplied with an alternating current, produced by an electronic converter, having an appropriate frequency of a few tens of kilohertz.

The system briefly described above allows to reduce any heat loss occurring in normal heating elements for cooking which use an electric resistor, since the induction coil directly heats the bottom of the pot, allowing higher efficiencies and lower heat inertia.

The technical problems that arise are linked to energy consumption and distribution in ranges with multiple heating elements. First of all, the power levels involved are considerable for each induction coil, and can be such as to exceed, if added together, the maximum power available to the user.

Furthermore, in order to reduce costs, a single electronic converter is used which generates a high-frequency alternating current. This current is then sent to each one of the induction coils by means of switching devices, such as relays or the like, which are activated in sequence. Ranges with multiple heating elements conventionally have a single converter powering two or three induction coils, one at a time, by means of relays, in order to avoid a power demand exceeding the maximum available level.

Another technical problem that arises is linked to the actual presence or absence of the pot on the induction coil being powered.

In fact, should an induction coil be inadvertently left powered without a pot, excessively strong high-frequency currents would flow through said coil. Should this happen, the converter must be immediately halted and kept off whenever the coil without a pot should deliver power.

SUMMARY OF THE INVENTION

The aim of the present invention is to provide a control device particularly for induction cooking ranges with multiple heating elements, wherein a single electronic converter supplies a set of induction coils connectable to the converter either individually or in parallel-connected pairs, said device allowing to share the power in an optimum manner among said set of coils, the maximum overall power whereof is higher than the power available to the user.

Within the scope of this aim, an object of the present invention is to provide a device that eliminates any risk of circulation of overcurrents for induction coils inadvertently left on without a pot, or with an unadapted pot, identifying which coil does not have an adequate pot even when there are several parallel-connected active coils.

Another object of the present invention is to provide a control device particularly for induction cooking ranges with multiple heating units being highly reliable, relatively easy to manufacture, and having competitive costs.

This aim, these objects, and others which will become apparent hereinafter are achieved by a control device particularly for induction cooking ranges with multiple heating units according to the invention, comprising a plurality of induction coils, characterized in that said induction coils can be electrically parallel-connected to each other, and comprising: means for engaging said induction coils adapted to connect individual induction coils or pairs of induction coils to a single electric power converter; and means for sensing the absence of a pot and the presence of an unsuitable pot on a particular induction coil, said sensor means being electrically connected to control means adapted to select, on user's command, the induction coils to be activated and the power to be carried to each individual induction coil, and to send shares of the power generated by said single electronic converter to each active induction coil.

BRIEF DESCRIPTION OF THE DRAWINGS

Further characteristics and advantages of the invention will become apparent from the description of a preferred but not exclusive embodiment of a control device particularly for induction cooking ranges with multiple heating units according to the invention, illustrated only by way of non-limitative example in the accompanying drawings, wherein.

DESCRIPTION OF THE PREFERRED EMBODIMENTS

Figure 1:
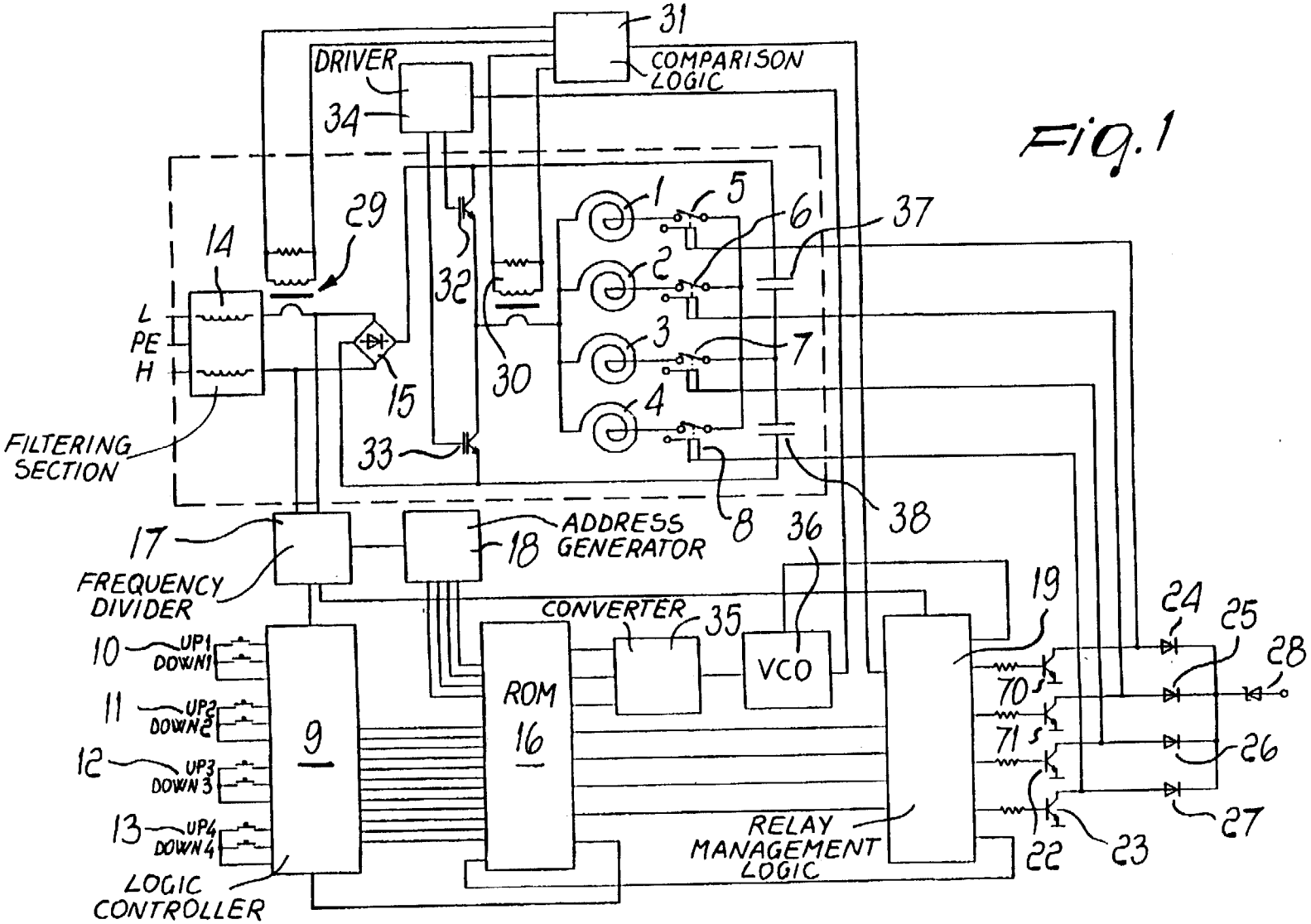
FIG. 1 is a diagram of a control device particularly for induction cooking ranges with multiple heating units according to the invention, in an embodiment for four induction coils.

With reference to FIG. 1, a control device particularly for induction cooking ranges with multiple heating units comprises four induction coils 1, 2, 3, and 4, and a single electronic converter; said coils are electrically parallel-connectable one another.

Each induction coil 1, 2, 3, and 4 is connected to a connection or engagement relay 5, 6, 7, and 8 respectively, and the energization coils of each relay are supplied, as explained hereinafter, by a voltage +VR.

The device comprises: a single electronic converter 35 capable of supplying the induction coils 1, 2, 3, and 4 individually or in pairs; and means for sensing the presence or absence of a pot, or the presence of an unadapted pot, on a particular induction coil.

The sensor means are electrically connected to control means that select, on user's command, which induction coil has to be activated and how much power ha to be sent to each individual induction coil, and control the transmission of shares of the power generated by the single electronic converter to each active induction coil, when there is more than one simultaneously active induction coil.

Said control means comprise a logic controller 9 for setting the power of each induction coil, which is provided with pairs of buttons 10, 11, 12, and 13 for power adjustment for each individual induction coil 1, 2, 3, and 4. Each pair of buttons 10, 11, 12, and 13 includes a power increase and a power decrease buttons.

The logic controller 9 is electrically connected to a read-only memory (technically known as ROM, term which will be used hereinafter for convenience in exposition) 16, in which program-based control means are stored in preset addresses.

For the timing and synchronization of the electronic devices a zero detector and first frequency divider 17 is provided, which taps the mains frequency between the filtering section 14 and the bridge 15, sending a first clock signal 42 (termed "SET CLOCK" signal) to the logic controller 9, a second clock signal 43 (termed "RELAY MANAGEMENT CLOCK" signal) to the relay management logic 19, and a third clock signal 44 (termed "DIVIDER CLOCK" signal) to a frequency divider and address generator 18, which generates addresses for the ROM 16.

The logic controller 9, together with the frequency divider 17 and the address generator 18, drives the ROM 16 by sending power values set with the buttons 10, 11, 12, and 13. Said ROM, on the basis of the values received from the logic controller 9 and of the addresses received from the generator 18, sends activation signals to a logic 19 for managing the connection relays, which closes the power transmission relays 5, 6, 7, and 8 as a function of every possible setting of the power levels to be transmitted to the pots that is activated by the user.

In particular, the management logic 19 for the relays 5, 6, 7, and 8 supplies, by means of appropriate resistors, the base terminals of transistors 20, 21, 22, and 23, whose emitter terminals are connected to the ground and whose corresponding collector terminals are connected to the anode terminals of diodes 24, 25, 26, and 27, to the cathode terminals whereof said voltage +VR for supplying power to the coils of the relays 5, 6, 7, and 8 is provided by means of a Zener diode 28.

The sensor means comprise a first transformer coupling 29, which senses the current in input at the mains frequency absorbed by the converter powering the induction coils 1, 2, 3, and 4, and then a second transformer coupling 30 that senses the high-frequency current absorbed by said induction coils and a comparison logic 31 generating an inhibit signal 45 (termed "OVERCURRENT" signal) if the ratio between the input current and the absorbed high-frequency current decreases with respect to normal values.

The inhibit signal is sent to a terminal of the management logic 19, which in turn sends an alarm signal 39 (termed "POT LACK TEST" signal) to the ROM 16; said ROM, after receiving said signal, performs in succession the pot presence tests or the pot incompatibility checking tests (i.e., it checks whether the pot is made or not of ferromagnetic material) on each of the individual induction coils 1, 2, 3, and 4. Once it has located the coil that caused the "overcurrent" signal, the management logic 19 disables it by opening its engagement relay.

The electronic power converter comprises electronic switches, for example, FIG. 1, IGBT transistors 32 and 33, each of which is electrically connected and driven by a driver 34, which is in turn driven by a signal frequency-modulated by a voltage-controlled oscillator 36 (technically known as VCO, a term that will be used hereinafter for simplicity in description).

In the first transformer coupling 29, the primary winding is arranged in series on a branch lying in output with respect to the filtering section 14 and the secondary winding is electrically connected to the comparison logic 31, whereas in the second transformer coupling the primary winding is arranged in series between the parallel of the coils 1, 2, 3, and 4 and the transistors 32 and 33, and the secondary winding is electrically connected to the comparison logic 31.

The ROM 16 can generate a setting limitation command signal 40 and send it to the logic controller 9 in order to block any further demands for power increase when the maximum power level has already been set by a user with the buttons 10, 11, 12, and 13.

The relay management logic 19 can generate a signal 41 (termed "TWO HEATING ELEMENTS" signal) for selecting a pair of induction coils and send it to the VCO 36 in order to modify the signal sent by said VCO to the driver 34.

The induction coils are electrically connected to capacitors 37 and 38, which, together with said induction coils, constitute a resonant load for the transistors 32 and 33.

For the sake of clarity in description, an example of embodiment with four induction coils has been chosen, the operation whereof is described hereinafter.

The mains voltage is rectified by the bridge 15, but not levelled, so as to obtain a unidirectional voltage. This voltage is applied to a half-bridge circuit, acting as electronic power converter, based on the solid-state switches (IGBT transistors or the like) 32 and 33, which are driven on or off alternatively, so as to provide a variable-frequency alternating voltage to supply the induction coils 1, 2, 3, and 4 and the capacitors 37 and 38.

In an embodiment with a 128-kilobyte ROM, the 17 address bits, used as inputs of the ROM 16, are divided as follows:

| | |
|---|---|
| A0÷A3 | timing signals |
| A4÷A6 | coil 1 power setting |
| A7÷A9 | coil 2 power setting |
| A10÷A12 | coil 3 power setting |
| A13÷A15 | coil 4 power setting |
| A16 | maximum current signal (alarm signal) |

The 8 bits with which the ROM 16 is provided are used as outputs and divided as follows:

| | |
|---|---|
| 00÷02 | bit control outputs of the DAC 8 |
| 03 | relay 5 control output |
| 04 | relay 6 control output |
| 05 | relay 7 control output |
| 06 | relay 8 control output |
| 07 | settable power limiting command signal output |

Starting from the mains frequency sensed by the zero sensor and frequency divider 17, the timing signals constituting the addresses A0+A3 of the ROM 16 are obtained by division. The work cycle of the ROM 16, lasting for a time T, is based on 16 timing intervals determined by A0+A3. These intervals are identical, and in each one the ROM 16 determines the power delivered by the converter and the activation of the relays 5, 6, 7, and 8 so as to obtain, in a complete work cycle, power values on the induction coils 1, 2, 3, and 4 averagely in agreement with the settings decided by the user with the buttons 10, 11, 12, and 13.

The zero sensor and first frequency divider 17, by means of appropriate frequency divisions, generates the "SET CLOCK" signal 42 and "RELAY MANAGEMENT CLOCK" 43 signal that synchronize the operation of the logic controller 9, which generates the address bits A4÷A15, and of the relay management logic 19. In this manner, all the operations performed by the electronic control devices are synchronized with each other and with the electrical mains.

The power of each induction coil is set on the buttons 10, 11, 12, and 13, each including a power increase button (termed "UP") and a power decrease button (termed "DOWN"). These buttons act on the logic controller 9, which provides the four address triplets A4+A6, A7+A9, A10+A12, and A13+A15; each triplet contains the coded information of the set power related to a specific induction coil. Since these are bit triplets, eight different power levels can be set for each induction coil.

During operation, the comparison logic 31 compares the active current absorbed from the mains and sensed by the first transformer coupling 29, and the total high-frequency current generated by the converter 35, sent to the heating elements, and sensed by the second transformer coupling 30. If a pot is lifted or is inadequate because it is constituted by nonferromagnetic material, or because of its small size, the ratio between the active current and the total current decreases with respect to normal values, thus allowing to detect this situation.

Accordingly, the "OVERCURRENT" signal 45 is activated and the management logic 19 in turn activates, through the "POT LACK TEST" line 39, the address A16 of the ROM 16. This activation lasts for the time required to perform a process for scanning and testing the induction coils 1, 2, 3, and 4 until the coil that caused the exceeding of the current threshold is identified. The scan consists in supplying voltage in succession to each individual coil for a short time interval to perform the current test. The scan affects only the coils that are on when the abnormal situation is sensed. The identified coil is disconnected by opening the respective relay connecting it to the converter for a certain time period, after which it is reconnected. If the same situation reoccurs, the scan and subsequent disconnection cycle resumes. An acoustic and light-emitting warning reports that the heating element is disconnected. The process is identical if more than one heating element is causing the exceeding of the current threshold.

The outputs O0+O2 of the ROM 16, by means of the DAC 15, supply the input voltage to the VCO 36. The generated frequency varies depending on whether one or two coils are connected to the electronic converter; the signal 41 "TWO HEATING ELEMENTS", generated by the management logic 19, appropriately modifies the operating frequency of the apparatus. The output of the VCO 36 is connected to the driving element 34 of the power converter. In this manner, the control forces the converter to assume an appropriate operating frequency, at which a given power is available on the coil. The frequency is variable: by way of example, between 50 kHz and 18 kHz, for a power level between 500 watts and 3000 watts.

The outputs O3+O6 of the ROM 16 constitute the input signals of the management logic 19 of the relays 5, 6, 7, and 8, which allow to connect each one of the induction coils 1, 2, 3, and 4 to the power converter. In this manner it is possible to use a single converter for four different induction coils. In each instance, one or two induction coils are connected to the converter by means of these relays 5, 6, 7, and 8.

The timing signals set the pace for the execution of the program-based control means stored in the ROM 16, the outputs whereof determine the frequency and therefore the current delivered by the converter and the closure and opening of the relays. Since the "DIVIDER CLOCK" signal is synchronized with the frequency of the electrical mains, the pace-setting is synchronized with the mains, and so is the closure and opening of the relays 5, 6, 7, and 8. A circuit for quick recovery of the magnetizing currents absorbed by the energization coils of said relays, based on the Zener diode 28, allows a faster opening of the contacts, and consequently a better synchronization.

The output O7 of the ROM 16 sends the maximum power limiting command signal 40 to the logic controller 9 in order to report that the sum of the power levels set on the induction coils 1, 2, 3, and 4 exceeds the maximum power level that can be delivered by the converter, which is set, merely by way of example, to 6 kilowatts.

In order to achieve maximum flexibility, each induction coil can be assumed to deliver up to 3 kilowatts. If the sum of the power values exceeds 6 kilowatts, it is necessary to limit the power on the induction coils: this occurs simply by inhibiting, through the activation of the maximum power limiting command signal 40, the "UP" keys of the buttons 10, 11, 12, and 13 when the sum of the set power values exceeds 6 kilowatts. The user can decide, according to his requirements, how to spread the power with no restriction as to the location of the induction coils used.

All the possible power combinations that can be set on each one of the four heating elements have been defined, and the frequency and operating current of the converter and the connection time of each induction coil required to achieve the average power levels corresponding to the set values have been determined for each one of said power combinations. This allows to define the program-based control means, comprising the program for the management of the four induction coils 1, 2, 3, and 4 stored in the ROM 16, and allowing to control said coils in a preset manner in all possible situations, both normal ones and those that can occur when a pot is lifted.

The coils 1, 2, 3, and 4 operate individually or in pairs in parallel. When two induction coils operate in parallel, the power delivered by the converter 35, if the frequency of the converter remained constant, would more than double due to the different value of the resonance frequency typical of the circuit. The "TWO HEATING ELEMENTS" logic variable 41 reports to the VCO 36 that two coils are powered in parallel; in this case, said VCO, with no need to modify the outputs O0+O2 of the ROM 16, varies the operating frequency of the converter, so as to appropriately adjust the power supplied to the heating elements.

Figure 2:
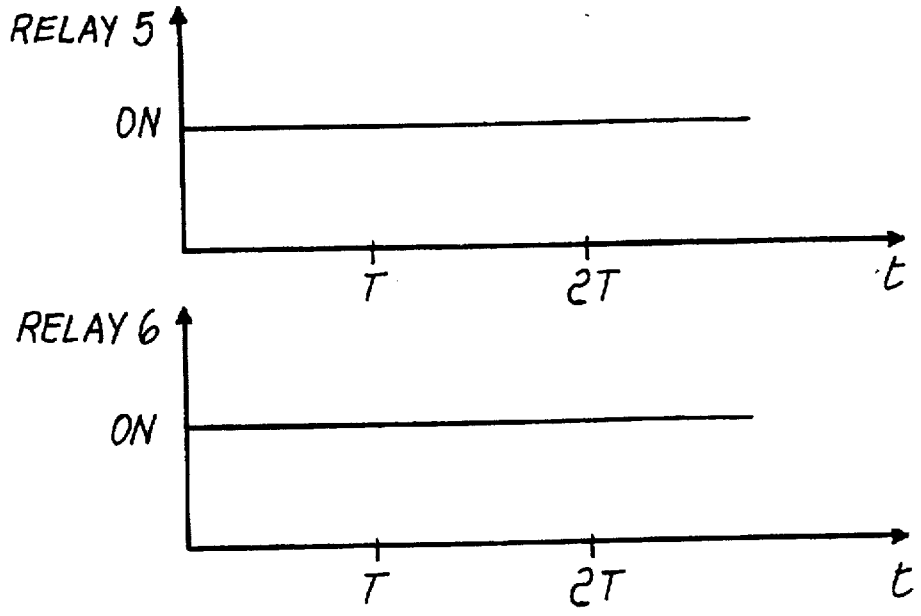
FIG. 2 shows two engagement relay state charts plotted as a function of time, related to a pair of induction coils requiring the same power and being simultaneously active.
Figure 3:
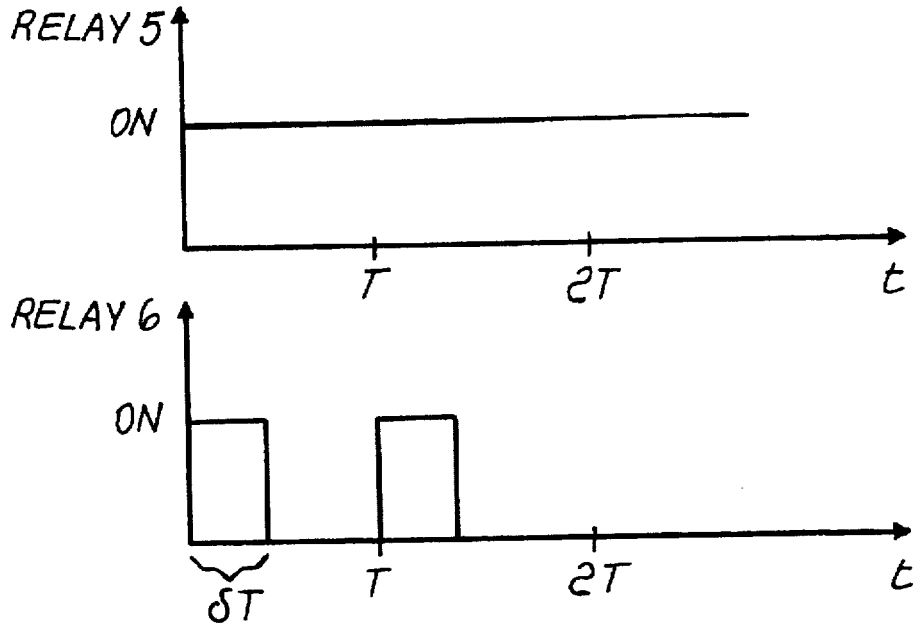
FIG. 3 shows two engagement relay state charts plotted as a function of time, related to a pair of induction coils being simultaneously active and requiring different power levels.

If the settings entail the use of two coils only, for example the coils 1 and 2, the relays 5 and 6, supposing that the set power levels are identical, are both energized throughout the cycle T, FIG. 2; if instead the power levels set on the two heating elements are different, and particularly if the power level of the coil 2 is lower, the relay 6 is energized only for a fraction [δ] of the work cycle T, FIG. 3.

Figure 4:
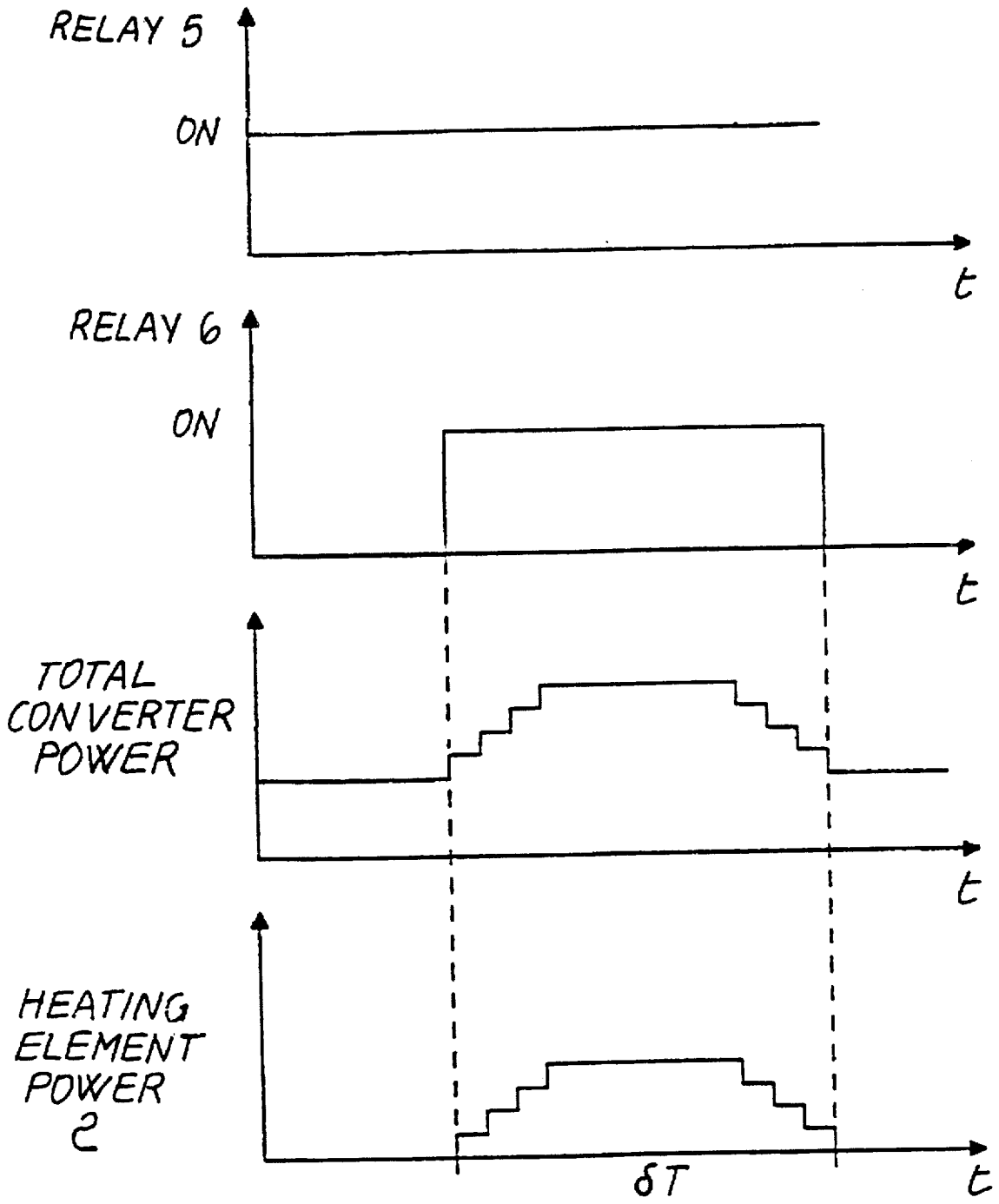
FIG. 4 shows the power charts, as a function of time, for a pair of induction coils being active at different times and requiring different power levels.

Furthermore, when one switches from one heating element to two heating elements in parallel, the outputs O0+O2 of the ROM 16 vary so as to allow a gradual increase in power, by means of a ramp or a sequence of several steps having a limited rise and an appropriate duration, instead of using a single step, as shown more clearly in FIG. 4. Likewise, in the reverse switch from two coils to one coil a gradual decrease in power occurs. This operating method allows to advantageously limit electrical noise on the mains ("flicker").

If the settings provide for the use of more than two coils, the entire cycle T is spread over the heating elements according to the set power level, so that the average power level assigned to each heating element corresponds to the set power level, on condition that no more than two of said heating elements be parallel-connected.

When the power level has to be limited to the maximum available, because the set values exceed 6 kilowatts and accordingly the function of the "UP" keys of the buttons 10, 11, 12, and 13 is inhibited, the indication of the occurrence of this situation is conveniently activated.

When the pot is lifted or the pot used is not made of ferromagnetic material or it is of reduced size, i.e. when a modification of the logic state of the input A16 of the ROM occurs, the heating element scan and test cycle is started.

Practical tests conducted on the device according to the invention have shown that it achieves all of the above described functions, providing a control device capable of conveniently limiting the maximum delivered power by spreading the supply according to the number of heating elements simultaneously active and capable of disconnecting the supply to heating elements left active although the pot has been lifted or is unadapted because of its material or size.

The invention thus conceived is susceptible of numerous modifications and variations, all of which are within the scope of the inventive concept. All the details may furthermore be replaced with other technically equivalent elements.

In practice, the electrical and electronic components used, as well as the dimensions, may be any according to the requirements.

What is claimed is:

1. In an induction cooling range with multiple heating units on which ferromagnetic objects as a pot are heatable, a control device comprising:

a plurality of induction coils being electrically parallel-connectable in pairs;

a single electronic high-frequency energy converter;

connection means for connecting individual ones and respectively pairs of said induction coils to said electronic converter;

sensing means for sensing, both absence of a pot or presence of a pot of unsuitable material on at least one of said induction coils;

control means for selecting upon a user's command the induction coils to be activated and a power level to be fed to each individual induction coil, and for sending shares of power generated by said electronic converter to each active induction coil, said control means being electrically connected to said sensor means;

resonance capacitors arranged in series with respect to said plurality of induction coils, said energy converter generating an alternating voltage causing voltage and current oscillations in each of said induction coils and in said resonance capacitors, frequency of said alternating voltage being controlled by said control means so as to transmit to each induction coil a power level being in accordance with the power level set by a user;

two of said induction coils being connected in parallel, and said control means, while the power level transmitted to a given induction coil at a certain moment is set, automatically driving said electronic converter to switch to a higher frequency so as to compensate for an increase in a typical resonance frequency of a circuit constituted by said plurality of induction coils in series to said resonance capacitors, said resonance frequency increase occurring while a second one of said induction coils is connected in parallel to a first coil.

2. The control device of claim 1, wherein said control means comprises a logic controller for setting the power level of each induction coil, and said connection means comprises engagement relays, the device further comprising:

a read-only memory (ROM) containing program-based control means, said logic controller being electrically connected to said ROM;

a first frequency divider generating, in cooperation with said logic controller, a clock signal synchronized with a mains frequency;

power adjustment buttons for said induction coils, said buttons being provided at said logic controller, a connection relay management logic for making the relays switch so as to transmit to each induction coil a power level in accordance with a level set by a user through said adjustment buttons.

3. The device according to claim 2, wherein said sensor means comprise a first transformer coupling for sensing current supplied by the power supply mains to said single energy converter, a second transformer coupling for sensing a high-frequency current supplied by the single converter to said plurality of induction coils, and a comparison logic for generating an inhibition signal when a ratio between the current supplied to the converter and the high-frequency current absorbed by the induction coils drops with respect to normal values, said inhibition signal being sent to said control means, which perform pot presence tests in succession on each individual induction coil and disconnect the induction coil found to be on and without a suitable pot.

4. The device of claim 2, further comprising a breakdown diode connected in series to diodes of respective coils of said relays, said breakdown diode becoming conductive at powering-off of one of said relays and supplying a high demagnetizing voltage to the coils of said relays so as to reduce switching delays of said relays.

5. The device according to claim 1, wherein said control means control switching of the relays and frequency generated by the converter so that mains current variations caused by periodic connection of one and respectively two induction coils in parallel occur with ramps and small steps having respectively a slope and a rise and a duration complying with statutory provisions related to the so-called "flicker".

* * * * *